US012546035B1

(12) United States Patent
Wang

(10) Patent No.: US 12,546,035 B1
(45) Date of Patent: Feb. 10, 2026

(54) ELASTIC YARN AND ELASTIC FABRIC

(71) Applicant: ADVANCE DENIM CO., LTD., Guangdong (CN)

(72) Inventor: Zongwen Wang, Guangdong (CN)

(73) Assignee: ADVANCE DENIM CO., LTD., Foshan (CN)

( * ) Notice: Subject to any disclaimer, the term of this patent is extended or adjusted under 35 U.S.C. 154(b) by 0 days.

(21) Appl. No.: 19/006,276

(22) Filed: Dec. 31, 2024

(51) Int. Cl.
*D02G 3/32* (2006.01)
*D02G 3/38* (2006.01)

(52) U.S. Cl.
CPC ..... *D02G 3/32* (2013.01); *D02G 3/38* (2013.01); *D10B 2401/061* (2013.01)

(58) Field of Classification Search
USPC ..... 57/3, 224
See application file for complete search history.

(56) References Cited

U.S. PATENT DOCUMENTS 3,458,987 A * 8/1969 Koyoshi ..... D02G 3/38 57/328
3,577,873 A * 5/1971 Waters ..... D02G 1/024 57/208
6,526,859 B1 * 3/2003 Ozawa ..... C08L 67/02 57/3
8,733,075 B2 * 5/2014 Mandawewala ..... D02G 3/38 139/1 R
10,132,006 B2 * 11/2018 Klein ..... D06M 15/00
11,873,409 B2 * 1/2024 Liu ..... C09D 11/033
11,931,479 B2 * 3/2024 Matsumura ..... D02G 3/448
12,213,556 B2 * 2/2025 Poegl ..... A43B 23/042
2015/0329995 A1 * 11/2015 Clement ..... D02G 3/38 428/592
2019/0127895 A1 * 5/2019 Cheng ..... D04B 1/10
2021/0277654 A1 * 9/2021 Rho ..... E04C 2/28
2022/0178053 A1 * 6/2022 Wang ..... D03D 15/292
2022/0235496 A1 * 7/2022 Inoue ..... D02G 3/449
2023/0243074 A1 * 8/2023 Dandapure ..... B32B 5/073
(Continued)

FOREIGN PATENT DOCUMENTS

CN 207958610 U 10/2018
CN 207958617 U 10/2018
(Continued)

OTHER PUBLICATIONS

Powar et al. "Application of Ozone Treatment for the Decolorization of the Reactive-Dyed Fabrics in a Pilot-Scale Process—Optimization through Response Surface Methodology" Jan. 8, 2020. https://www.mdpi.com/2071-1050/12/2/471 (Year: 2020).*
(Continued)

*Primary Examiner* — Grace Huang

(57) ABSTRACT

Disclosed is an elastic yarn and an elastic fabric, relating to the technical field of textile. The elastic yarn includes a core yarn and a wrapping yarn, where the core yarn is composed of at least one elastic filament; the wrapping yarn is a yarn made of short fiber; and the wrapping yarn spirally wraps the core yarn. The elastic yarn provided by this application is used as a weft yarn and matches with an after treatment processing process, and the elastic fabric of this application has a good and stable elasticity (without elasticity loss of the fabric), and achieves a good skin feeling and a difficulty in causing scratch injury on the skin, and a stable shrinkage rate.

10 Claims, 3 Drawing Sheets

(56) References Cited

U.S. PATENT DOCUMENTS

| | | | | |
|---|---|---|---|---|
| 2023/0256141 | A1* | 8/2023 | Bassett | A61L 29/145 428/36.5 |
| 2023/0383444 | A1* | 11/2023 | Budd | D02G 3/025 |
| 2024/0279849 | A1* | 8/2024 | Yasuda | D03D 15/47 |
| 2024/0294354 | A1* | 9/2024 | Yasuda | D03D 15/47 |
| 2025/0064145 | A1* | 2/2025 | Lee | D03D 15/217 |
| 2025/0122651 | A1* | 4/2025 | Matsumoto | D02G 3/447 |

FOREIGN PATENT DOCUMENTS

| | | | | | |
|---|---|---|---|---|---|
| CN | 112760779 | A | * | 5/2021 | D02G 3/328 |
| CN | 113089146 | A | * | 7/2021 | D02G 3/328 |
| CN | 117188004 | A | * | 12/2023 | D02G 3/34 |
| EP | 0548474 | A1 | * | 6/1993 | D04B 1/106 |
| JP | 58169534 | A | * | 10/1983 | D02G 3/36 |
| KR | 101117950 | B1 | * | 2/2012 | A41B 11/004 |

OTHER PUBLICATIONS

Eren et al. "A New Sight of Ozone Usage in Textile: Improving Flame Retardant Properties" Mar. 7, 2024. https://pmc.ncbi.nlm.nih.gov/articles/PMC10974728/ (Year: 2024).*

Jangala et al. "Making Rayon Fiber 1999." Textile Science, University of TN. Jul. 5, 2006. http://www.mindfully.org/plastic/cellulose/rayon-fiber.htm (Year: 1999).*

"Sustain Your Style." 2024. https://www.sustainyourstyle.org/en/rayon-viscose-modal (Year: 2024).*

Sunol, J J et al. "Thermal Degradation of Lyocell, Modal and Viscose Fibers Under Aggressive Conditions." Journal of Thermal Analysis and Calorimetry, vol. 87 (2007), 1, 41-44. (Year: 2007).*

Textiles—Test Method for Tensile Elasticity of Woven Fabrics, FZ_T 01034-2008, 2008.

AATCC 135 Fabric Home Washing Size Changes, AATCC 135-2015, 2015.

* cited by examiner

ELASTIC YARN AND ELASTIC FABRIC

TECHNICAL FIELD

This application relates to the technical field of textile, and mainly relates to an elastic yarn and an elastic fabric.

BACKGROUND

A jean fabric is interwoven by a warp yarn and a weft yarn. An elastic jean fabric is generally interwoven by the warp yarn and an elastic weft yarn. The elastic weft yarn generally uses a core-spun yarn. The core-spun yarn uses an elastic filament as a core, and non-elastic short fiber wraps the outside of the elastic filament. The short fiber has a high water absorption rate, and may shrink when being heated. A traditional core-spun yarn structure may have a defect that a shrinkage rate of the elastic jean fabric is instable. According to a general core-spun yarn manufacturing process, firstly, the short fiber is processed into a roving yarn, and then, the roving yarn wraps the elastic filament through a spinning frame. In a wrapping process, the elastic filament may be drafted, and a draft multiple is great (the draft multiple is 2 to 4 times, and is generally 3.5 times or higher). Therefore, the elastic filament of an elastic fabric manufactured by this kind of core-spun yarn is in a high-drafting state for a long time, and the elastic filament may easily generate an "elastic fatigue" problem, causing great reduction of elastic performance. Additionally, the processing by a water washing working procedure (enzyme bleaching, chlorine bleaching, manganese bleaching, etc.) is needed if the jean fabric is manufactured into jean clothes, and the elastic filament may be further damaged, so the jean clothes may locally generate an irreversible elasticity loss phenomenon to cause a serious quality problem.

In order to protect the elastic filament, in the wrapping process, a twist degree of the roving yarn on the elastic filament may be generally increased, so that the elastic filament is tightly wrapped to reduce the damage of the water washing working procedure to the elastic filament. However, in such a manner, the elastic filament may receive excessive extrusion, so the elastic performance of the jean fabric will be reduced, and stronger force may be needed during stretching. It may cause defects that some positions receive great pressure in a wearing process of the manufactured jean clothes, and a wearing feeling is uncomfortable. At the same time, the holding of the short fiber on a surface of the core-spun yarn may be too tight, and a hand feeling of the yarn is stiff, so the problems of a poor wearing skin feeling of the manufactured jean clothes, or even skin injury caused by scratching may occur.

Based on the above, how to keep a good elasticity (without fabric elasticity loss) of the elastic jean fabric, achieve a good skin feeling and a difficulty in causing scratch injury on the skin and ensure the stable shrinkage rate of the jean fabric is a technical problem generally existing in jean fabric industry, and it restricts the development of the elastic fabric.

SUMMARY

In view of the defects in the prior art, this application aims at providing an elastic yarn and an elastic fabric to solve the problems of a great shrinkage rate and elasticity instability of an existing elastic jean fabric due to adoption of a core-spun yarn.

This application has the following technical solution:

An elastic yarn is provided, including a core yarn and a wrapping yarn, where the core yarn is composed of at least one elastic filament;

the wrapping yarn is a yarn made of short fiber; and the wrapping yarn spirally wraps the core yarn.

A draft multiple of the core yarn of the elastic yarn is 1 to 3.

A twist degree of the wrapping yarn of the elastic yarn before spirally wrapping the core yarn is 8 twists/inch to 30 twists/inch; and a number of windings of the wrapping yarn on per 1 cm of the core yarn is more than 15.

By taking every 4 cm of the core yarn of the elastic yarn as a cycle, a number of windings of the wrapping yarn on per 1 cm of the core yarn in every 4 cm of the core yarn is sequentially reduced by 2.

The wrapping yarn of the elastic yarn is a blended yarn of cotton fiber and novel fiber, and according to a mass ratio of a blending proportion, the cotton fiber accounts for 60% to 80%, and the novel fiber accounts for 20% to 40%;

the novel fiber sequentially includes an inner layer, a middle layer and an outer layer from inside to outside, the inner layer is a chemical fiber layer with a special-shaped cross section, the middle layer is a low-melting-point polyurethane layer, the outer layer is a regenerated cellulose layer, and a cross section area ratio of the outer layer to the middle layer to the inner layer is (3-4):1:(5-7);

the inner layer is made of one of polyester resin, polyamide resin, polyvinyl alcohol resin or polypropylene resin;

the middle layer is made of polyurethane with a melting point below 100° C.;

the outer layer is made of viscose or modal; and a melting point of a material selected for the outer layer and the inner layer is higher than 165° C.

An elastic fabric is provided, interwoven by a warp yarn and a weft yarn, where the weft yarn uses the elastic yarn.

The warp yarn of the elastic fabric uses a pure cotton yarn or a cotton blended yarn, and a yarn count of the warp yarn ranges from 6 S to 50 S.

The elastic fabric is processed by an after treatment process, and the after treatment process includes the following steps:

(1) performing singeing treatment on the elastic fabric: respectively performing singeing treatment on a front side and a back side of the elastic fabric in a singeing machine at a singeing temperature of 300° C. to 500° C. and a singeing speed of 60 m/min to 80 m/min;

(2) performing desizing treatment on the elastic fabric: adding a desizing enzyme into a desizing machine to perform desizing treatment at a desizing enzyme concentration of 6 g/L to 10 g/L, a desizing treatment temperature of 50° C. to 65° C. and a desizing speed of 60 m/min to 80 m/min;

(3) performing drying treatment on the elastic fabric at a drying treatment temperature of 110° C. to 130° C. for a treatment time of 3 min to 5 min;

(4) performing hot air flapping treatment on the elastic fabric at a hot air temperature of 90° C. to 120° C.;

(5) performing ozone treatment on the elastic fabric: introducing ozone in a sealed environment, soaking the elastic fabric in a liquid with a pH value being 8 to 8.5, and setting an ozone introduction amount to be 0.2 L/min to 1.5 L/min to perform ozone treatment for a treatment time of 10 min to 20 min;

(6) performing softening treatment on the elastic fabric: adding a fiber softening degrading agent into water at an addition amount of the fiber softening degrading agent accounting for 3% to 5% of a volume of water to perform softening treatment for a treatment time of 10 min to 20 min; and (7) Performing preshrinking treatment on the elastic fabric: performing preshrinking treatment by using a preshrinking machine at a preshrinking speed of 15 m/min to 25 m/min, a rubber blanket compression degree of 17% to 19%, a rubber blanket temperature of 120° C. to 140° C., and a blanket drying tube temperature of 120° C. to 140° C.

In Step (4), the hot air flapping treatment on the elastic fabric is divided into four stages, and a flapping frequency is set to be flapping once per 1 second to 5 seconds: at a first stage, the hot air temperature is 120° C., and the flapping speed is 250 m/min; at a second stage, the hot air temperature is 110° C., and the flapping speed is 350 m/min; at a third stage, the hot air temperature is 100° C., and the flapping speed is 450 m/min; and at a fourth stage, the hot air temperature is 90° C., and the flapping speed is 550 m/min;

in step (5), the liquid is a sodium hydroxide solution; and in step (6), the fiber softening degrading agent is prepared from the following raw materials in percentage by weight:

15% to 25% of polyoxyethylene isooctyl ether phosphate, 25% to 55% of dodecyl dimethyl hydroxypropyl phosphate betaine, 1% to 5% of an auxiliary agent, and the balance water;

the auxiliary agent is hexadecyl trimethyl ammonium bromide; and a preparation process of the fiber softening degrading agent includes: mixing the auxiliary agent with water to obtain a mixed liquid; adding the polyoxyethylene isooctyl ether phosphate and the dodecyl dimethyl hydroxypropyl phosphate betaine into the mixed liquid, performing uniform mixing, and performing stirring at 45° C. to 55° C. and at a speed of 120 r/min to 320 r/min for 8 min to 15 min to obtain the fiber softening degrading agent.

The elastic fabric is a jean fabric, and a fabric structure is 3/1 right twill.

This application has the following beneficial effects: the elastic yarn provided by this application is used as the weft yarn and matches with the after treatment processing process, so the elastic fabric of this application has a good and stable elasticity (without elasticity loss of the fabric), and achieves a good skin feeling and a difficulty in causing scratch injury on the skin, and a stable shrinkage rate.

In the figures, 1 denotes a feeding roller, 2 denotes a core yarn bobbin, 4 denotes a tangential belt, 5 denotes a hollow spindle, 8 denotes a balloon filament guide, 9 denotes a yarn guide roller, 10 denotes a compression roller, 11 denotes a reciprocating motion yarn guide, 12 denotes a crimped roller, 13 denotes a bobbin, 31 denotes a wrapping yarn, 32 denotes a core yarn, 41 denotes an inner layer, 42 denotes a middle layer, 43 denotes an outer layer, and 411 denotes a special-shaped cross section.

DETAILED DESCRIPTION

This application provides an elastic yarn and an elastic fabric. In order to make the purposes, technical solutions and effects of this application clearer and more explicit, further detailed descriptions of this application are provided below. It should be understood that the specific embodiments described here are merely used to describe this application but are not intended to limit this application.

For the unit of a yarn count, S is an English yarn count number, which refers to a multiple number of a length of one pound of yarn at an official regain relative to 840 yards. D is an abbreviation of Denier, is a fineness representing method of chemical fiber, and refers to a weight in grams of a filament with a length of 9000 m at an official regain.

A draft multiple refers to a multiple number of drafting an elastic filament by certain tensile force, for example, if the draft multiple is 2 times, a length is lengthened by 2 times.

Figure 1:
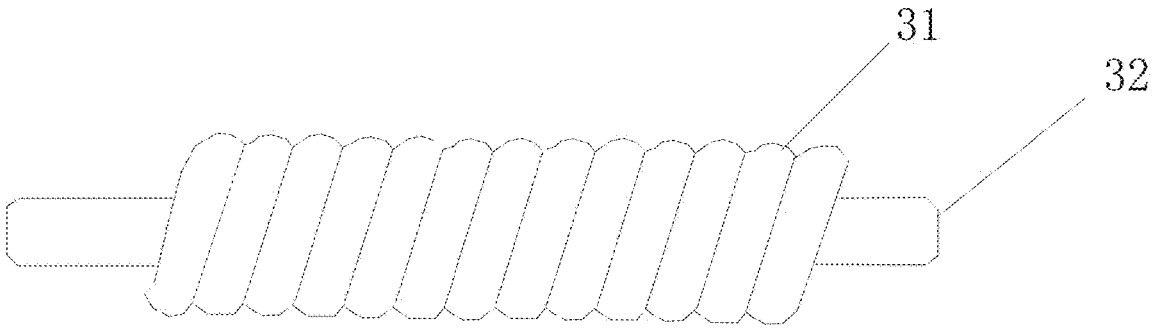
FIG. 1 is a schematic structural diagram of an elastic yarn (in a non-stretched state) according to this application.
Figure 2:
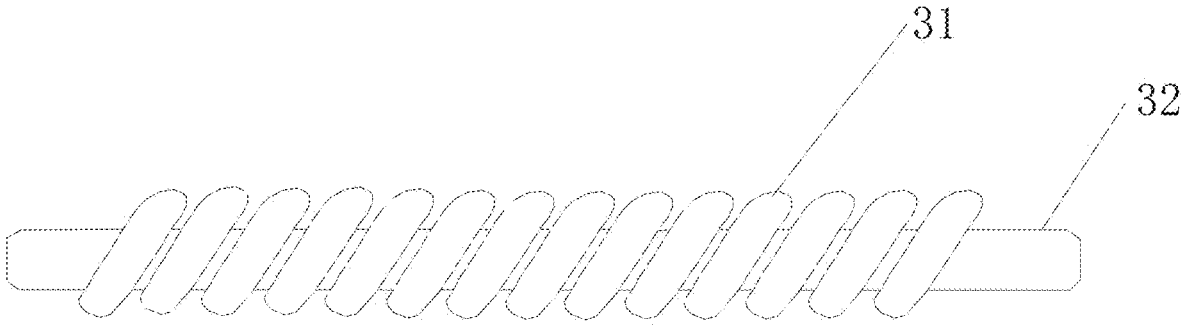
FIG. 2 is a schematic structural diagram of an elastic yarn (in a stretched state) according to this application.

This application provides an elastic yarn, as shown in FIG. 1 and FIG. 2, including a core yarn 32 and a wrapping yarn 31.

The core yarn 32 is composed of at least one elastic filament.

The wrapping yarn 31 is a yarn made of short fiber.

The wrapping yarn 31 spirally wraps the core yarn 32, so that the core yarn 32 is not exposed out.

In the technical solution of this application, if the elastic yarn of this application is in a non-stretched state, the wrapping yarn 31 may uniformly and spirally wrap the core yarn 32, so the elastic filament is not exposed out. Therefore, the damage to the elastic filament in a subsequent water washing working procedure may be reduced, and elastic performance of the elastic filament is protected.

Further, a draft multiple of the core yarn 32 is 1 to 3. Preferably, the draft multiple of the core yarn 32 is 1 to 1.5, so that the elastic filament of the core yarn 32 does not need to be in a stretched state for a long time, an occurrence probability of elastic fatigue of the elastic filament is reduced, the elastic filament may maintain good stretching and recovery performance, and the core yarn 32 maintains the performance stability for a long time, i.e., the elastic yarn of this application has stable elastic performance.

Further, a number of windings of the wrapping yarn 31 on per 1 cm of the core yarn 32 is more than 15, is preferably 15 to 50, and is more preferably 20 to 40. Therefore, the wrapping yarn 31 may uniformly wrap a surface of the core yarn 32 to protect the core yarn 32 from being exposed out, and the core yarn 32 may be effectively protected from damage caused by friction, etc.

Further, by taking every 4 cm of the core yarn 32 as a cycle, a number of windings of the wrapping yarn 31 on per 1 cm of the core yarn 32 in every 4 cm of the core yarn 32 is sequentially reduced by 2. For example, in the first 4 cm of the core yarn 32, the number of windings of the wrapping yarn 31 on the $1^{st}$ centimeter of the core yarn 32 is 30, the number of windings on the $2^{nd}$ centimeter of the core yarn 32 is 28, the number of windings on the $3^{rd}$ centimeter of the core yarn 32 is 26, and the number of windings on the $4^{th}$ centimeter of the core yarn 32 is 24; in the second 4 cm of the core yarn 32, the number of windings of the wrapping yarn 31 on the $1^{st}$ centimeter of the core yarn 32 is 30, the number of windings on the $2^{nd}$ centimeter of the core yarn 32 is 28, the number of windings on the $3^{rd}$ centimeter of the core yarn 32 is 26, and the number of windings on the $4^{th}$ centimeter of the core yarn 32 is 24; and this cycle is repeated in such a manner.

During wrapping processing, different wrapping numbers may be realized by changing a twist degree of wrapping and twisting. By taking every 4 cm of the core yarn 32 as a cycle, in every 4 cm of the core yarn 32, a twist degree change of twisting of the wrapping yarn 31 on per 1 cm of the core yarn 32 is sequential reduction by 5%. For example, in the first 4 cm of the core yarn 32, the twist degree of twisting of the wrapping yarn 31 on the $1^{st}$ centimeter of the core yarn 32 is 1300 twists/m, the twist degree of twisting on the $2^{nd}$ centimeter of the core yarn 32 is 1235 twists/m, the twist degree of twisting on the $3^{rd}$ centimeter of the core yarn 32 is 1173 twists/m, and the twist degree of twisting on the $4^{th}$ centimeter of the core yarn 32 is 1115 twists/m; in the second 4 cm of the core yarn 32, the twist degree of twisting of the wrapping yarn 31 on the $1^{st}$ centimeter of the core yarn 32 is 1300 twists/m, the twist degree of twisting on the $2^{nd}$ centimeter of the core yarn 32 is 1235 twists/m, the twist degree of twisting on the $3^{rd}$ centimeter of the core yarn 32 is 1173 twists/m, and the twist degree of twisting on the $4^{th}$ centimeter of the core yarn 32 is 1115 twists/m; and this cycle is repeated in such a manner.

When the elastic fabric made of the elastic yarn is stretched, both the elastic yarn and the wrapping yarn 31 may elongate to a certain degree. The number of windings of the wrapping yarn 31 on the core yarn 32 is in gradient change, so there is a sufficient space for the wrapping yarn 31 to extend. At the same time, no excessive torsion occurs at a connection position of loops, fiber of the wrapping yarns 31 may be tightly held, the elastic fabric may keep a good skin feeling, and the occurrence of a problem of skin injury by scratching is avoided.

Further, a yarn count of the wrapping yarn 31 may be 10 S to 80 S, and a denier number of the core yarn 32 may be 20 D to 500 D.

The yarn count of the wrapping yarn 31 is not suitable to be too high, a strength of the yarn will be reduced if the yarn count is high, end breakage may easily occur during wrapping, and a quality problem may occur.

The core yarn 32 is manufactured by processing the elastic filament, the elastic filament may be a polyurethane filament, a polyolefin filament, a rubber filament, a double-component filament, etc.

The wrapping yarn 31 is a yarn manufactured by processing short fiber. The short fiber refers to fiber with a fiber length between 10 mm and 90 mm. The short fiber may be natural fiber or chemical fiber. The short fiber may be cotton fiber, tencel fiber, modal fiber, polyester fiber, polyamide fiber, etc. The short fiber is preferably cotton fiber, because the cotton fiber is in common use. At the same time, the cotton fiber is nature fiber, and has a good skin-friendly and comfortable touching sense.

The wrapping yarn 31 is a single yarn. Before wrapping, an original twist degree of the wrapping yarn is 8 twists/inch to 30 twists/inch. After twisting wrapping, the twist degree of the wrapping yarn 31 may be improved, but the specific twist degree of the wrapping yarn in a finished product elastic yarn cannot be measured. Therefore, in the solution of this application, the twist degree of the described wrapping yarn is the original twist degree before wrapping.

Further, the wrapping yarn 31 may include novel fiber. Preferably, the wrapping yarn 31 may be a blended yarn of cotton fiber and novel fiber. According to a mass ratio of a blending proportion, the cotton fiber accounts for 60% to 80%, and the novel fiber accounts for 20% to 40%. The blending proportion of the blended yarn is generally calculated by dry weight, and represents the proportion of each fiber in the blended yarn.

Figure 3:
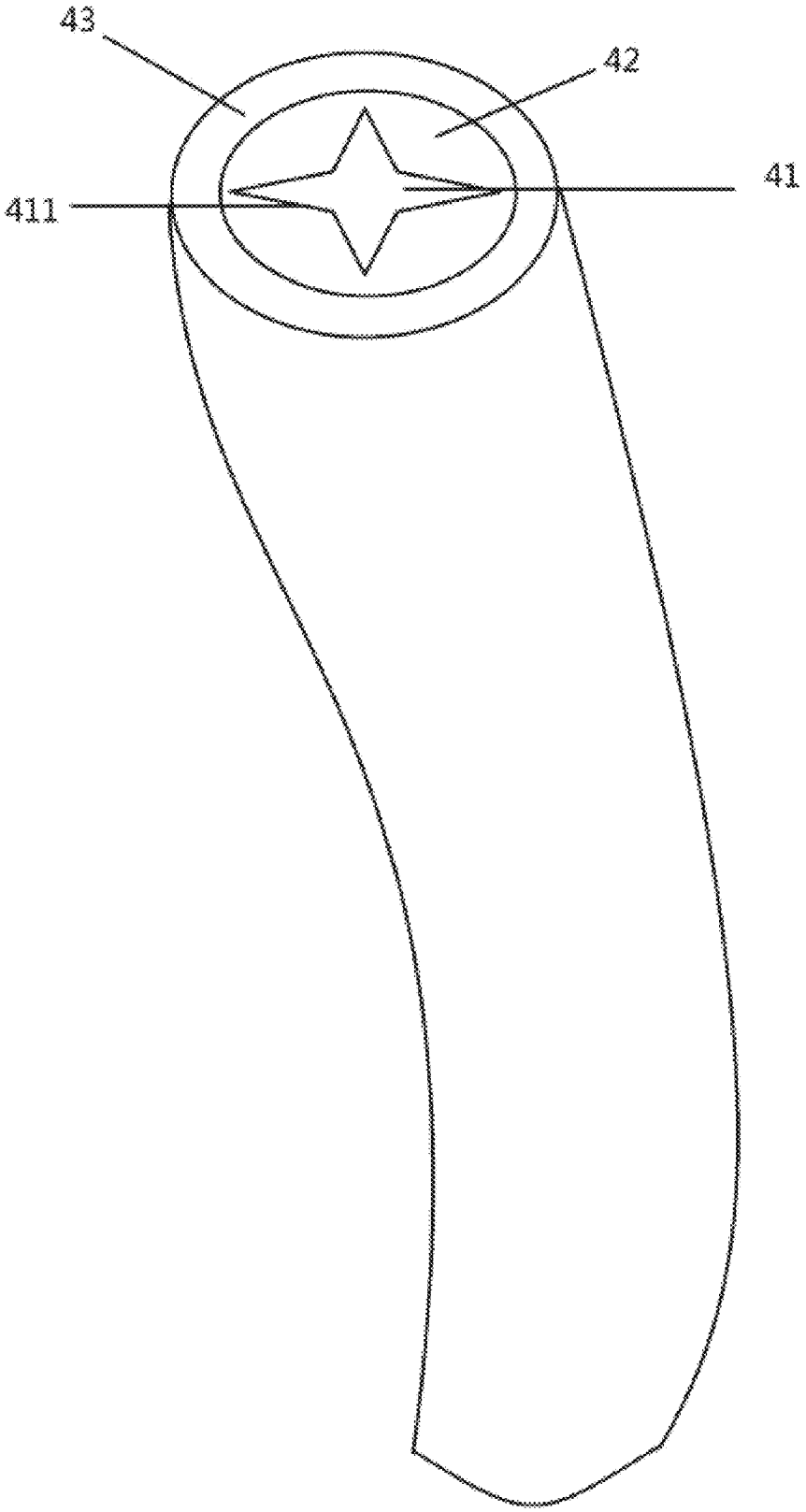
FIG. 3 is a schematic structural diagram of a novel fiber in an elastic yarn according to this application.

The novel fiber has a three-layer structure, and is manufactured by three-channel coaxial spinning. Solutions of three layers of raw materials are respectively prepared. One solution corresponds to one channel. Specifically, as shown in FIG. 3, the novel fiber sequentially includes an inner layer 41, a middle layer 42 and an outer layer 43 from inside to outside, the inner layer 41 is a chemical fiber layer with a special-shaped cross section 411, the middle layer 42 is a low-melting-point polyurethane layer, the outer layer 43 is a regenerated cellulose layer, and a cross section area ratio of the outer layer 43 to the middle layer 42 to the inner layer 41 is (3-4):1:(5-7).

A material of the inner layer 41 shall select chemical fiber resin with high strength and good stability, and, for example, may be polyester resin, polyamide resin, polyvinyl alcohol resin or polypropylene resin. The fiber prepared from these kinds of resin has high tensile strength and structure stability, so the integral tensile strength and durability of the elastic yarn are higher, and the elastic yarn cannot be easily damaged. In addition, good heat resistance is also realized, an effect that the inner layer 41 may still maintain the original form when the middle layer 42 is in melting collapse state may be ensured, and in addition, the manufactured elastic fabric cannot obviously shrink after being washed for many times. The inner layer 41 has the special-shaped cross section 411, and the special-shaped cross section 411 may be in a cruciform or a triangle shape.

The middle layer 42 is a low-melting-point polyurethane layer, and a low melting point refers to a melting point of the polyurethane below 100° C. A temperature in a preshrinking step and a drying step in an after treatment process may easily exceed the melting point temperature, so that the middle layer 42 is partially molten or totally molten. Correspondingly, the melting points of materials selected for the outer layer 43 and the inner layer 41 shall be higher than 165° C., and preferably higher than 180° C.

A material of the outer layer 43 may select viscose or modal.

The novel fiber has the following advantages:

Firstly, the overall performance of the elastic yarn is enhanced through the multilayer structure. The chemical fiber layer of the inner layer provides high strength and stability, and ensures the structure stability of the yarn, so deformation may not easily occur. The regenerated cellulose layer of the outer layer provides good moisture absorption performance and comfortable touching sense, so that a wearer feels more comfortable when wearing the elastic fabric. The elastic fabric may be subjected to the after treatment process, and preshrinking and drying steps may be included in the after treatment process, so after the after treatment, the low-melting-point polyurethane of the middle layer may be partially or totally molten to form holes between the inner layer and the outer layer. Due to a capillary effect, the moisture at the outer layer may be fast absorbed into the holes. Therefore, the wet permeability of the elastic yarn is good, and the wearing feeling of the elastic fabric is more comfortable.

Secondly, the strength and the comfort are both achieved. The inner layer and the outer layer use different chemical fiber materials, so the elastic yarn has high strength and comfort, may meet the durability requirement of garments, and may also provide a good touching sense and wet permeability.

This application further provides a preparation method of an elastic yarn. A hollow spindle is mainly used for wrapping. According to the hollow spindle wrapping spinning, the wrapping yarn is driven to rotate through the rotation of the hollow spindle, and the wrapping yarn wraps the core yarn of the hollow spindle in a spiral manner. During wrapping, the core yarn passes through a hollow position of the hollow spindle from a feeding roller, a draft multiple of the core yarn is 1 to 3, then, the wrapping yarn wraps the core yarn in a spiral manner, and an effect of uniformly wrapping the yarn onto the elastic filament is achieved by changing the twist degree of twisting.

Specifically, the preparation method of the elastic yarn includes the following steps:

Short fiber is made into a roving yarn, the roving yarn is made into a wrapping yarn through a spinning working procedure;

a core yarn bobbin is placed onto the feeding roller, the core yarn extends into the hollow spindle through being drafted by a predraft roller, and the predraft roller exerts a draft force with the draft multiple being 1 to 3 onto the core yarn and the core yarn is fed into the hollow spindle, the core yarn passes through a center of the hollow spindle, and the wrapping yarn of the hollow spindle is drafted out along with the rotation of the hollow spindle to realize wrapping above the hollow spindle, passes through a balloon filament guide, a yarn guide roller and a compression roller, and is finally wound.

Figure 4:
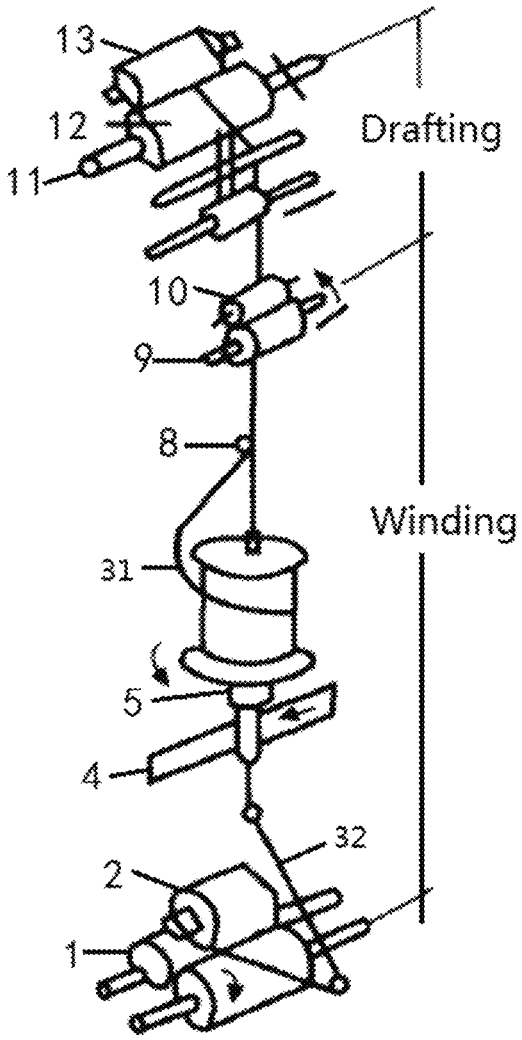
FIG. 4 is a schematic diagram of a production flow of an elastic yarn according to this application.

Specifically, in combination with FIG. 4, the preparation method of the elastic yarn specifically includes the following steps:

The core yarn bobbin 2 is placed onto the feeding roller 1, the core yarn bobbin 2 is driven through transmission to release the core yarn 32, the core yarn 32 passes through the hollow spindle 5 of a wrapping machine through a tangential belt 4 at a certain draft multiple under the effect of the predraft roller, and does linear motion, the wrapping yarn 31 is placed onto the hollow spindle 5, the hollow spindle 5 operates at a high speed under the effect of the transmission mechanism and enables the wrapping yarn 31 to unwind at a certain uniform rotating speed, and the core yarn 32 doing linear motion is uniformly wrapped to form the elastic yarn. The elastic yarn passes through the balloon filament guide 8, the position of the elastic yarn is controlled to be fixed, and then, the elastic yarn is wound onto a bobbin 13 parallel to the wrapping yarn 31 through the operation of the yarn guide roller 9, the compression roller 10, a reciprocating motion yarn guide 11 and a crimped roller 12.

In the wrapping process, the twist degree of twisting of the wrapping yarn is 900 twists/m to 1500 twists/m.

In a case that by taking every 4 cm of the core yarn as a cycle, the number of windings of the wrapping yarn on per 1 cm of the core yarn in every 4 cm of the core yarn is sequentially reduced by 2, and the twist degree change of twisting of the wrapping yarn on per 1 cm of the core yarn is sequential reduction by 5%.

This application further provides an elastic fabric. The elastic fabric is interwoven by a warp yarn and a weft yarn, and the weft yarn uses the above elastic yarn.

The warp yarn uses a pure cotton yarn or a cotton blended yarn, and a yarn count of the warp yarn ranges from 6 S to 50 S.

Further, the elastic fabric of this application is a jean fabric, and a fabric structure is 3/1 right twill.

In order to further improve the skin feeling of the elastic fabric, the elastic fabric is processed by an after treatment process, and the after treatment process includes the following steps:

(1) Singeing treatment is performed on the elastic fabric: singeing treatment is respectively performed on a front side and a back side of the elastic fabric in a singeing machine at a singeing temperature of 300° C. to 500° C. and a singeing speed of 60 m/min to 80 m/min.

(2) Desizing treatment is performed on the elastic fabric: a desizing enzyme is added into a desizing machine, a desizing enzyme concentration is 6 g/L to 10 g/L, a desizing treatment temperature is 50° C. to 65° C., and a desizing speed is 60 m/min to 80 m/min.

(3) Drying treatment is performed on the elastic fabric: drying treatment is performed in a drying machine, a drying treatment temperature is 110° C. to 130° C., and a treatment time is 3 min to 5 min.

Through the above singeing treatment and drying treatment, the low-melting-point polyurethane of the middle layer may be partially or totally molten to form holes between the inner layer and the outer layer. Due to the capillary effect, the holes may achieve an effect of moisture guide channels, and the moisture at the outer layer may be absorbed into the holes. Therefore, the moisture absorption and sweat releasing effects of the elastic fabric are good, and the wearing feeling is comfortable.

(4) Hot air flapping treatment is performed on the elastic fabric: a hot air temperature is 90° C. to 120° C.

Further, the hot air flapping treatment is divided into four stages, and a flapping frequency is constant and is set to be flapping once per 1 second to 5 seconds: at a first stage, the hot air temperature is 120° C., and a flapping speed is 250 m/min; at a second stage, the hot air temperature is 110° C., and the flapping speed is 350 m/min; at a third stage, the hot air temperature is 100° C., and the flapping speed is 450 m/min; and at a fourth stage, the hot air temperature is 90° C., and the flapping speed is 550 m/min.

(5) Ozone treatment is performed on the elastic fabric: ozone is introduced in a sealed environment, the elastic fabric is soaked in a liquid with a pH value being 8 to 8.5, an ozone introduction amount is set to be 0.2 L/min to 1.5 L/min, and a treatment time is 10 min to 20 min. The liquid may be a sodium hydroxide solution.

(6) Softening treatment is performed on the elastic fabric: a fiber softening degrading agent is added into water, an addition amount of the fiber softening degrading agent accounts for 3% to 5% of the volume of water, and a treatment time is 10 min to 20 min.

Further, the fiber softening degrading agent is prepared from the following raw materials in percentage by weight:

15% to 25% of polyoxyethylene isooctyl ether phosphate, 25% to 55% of dodecyl dimethyl hydroxypropyl phosphate betaine, 1% to 5% of an auxiliary agent, and the balance water;

the auxiliary agent is hexadecyl trimethyl ammonium bromide; and a preparation process of the fiber softening degrading agent is as follows: the auxiliary agent is mixed with water to obtain a mixed liquid; the polyoxyethylene isooctyl ether phosphate and the dodecyl dimethyl hydroxypropyl phosphate betaine are added into the mixed liquid, and are uniformly mixed, and stirring is performed at 45° C. to 55° C. and at a speed of 120 r/min to 320 r/min for 8 min to 15 min to obtain the fiber softening degrading agent.

By performing softening treatment on the elastic fabric, the fiber structure of the yarn may be further damaged. The elastic yarn includes the cotton fiber and the novel fiber, so the wet permeability is good, the fiber structure on the surface of the elastic yarn is further softened, and transfer may easily occur between the fiber, so a twist arc length at a connection position of loops of the wrapping yarn of the elastic yarn is reduced, a torsion degree of the fiber in this position is reduced, the fiber realizes relative smoothness, when the elastic fabric is stretched to extend, the torsion degree of the fiber in this position is low, and the problem of skin injury caused by scratching due to too tight holding of the fiber in this position may not occur. At the same time, during tension release, the fiber in this position may return to the original position, and the problem of skin injury caused by scratching due to stretching extension or tension release recovery of the elastic fabric may not occur.

(7) Preshrinking treatment is performed on the elastic fabric: preshrinking treatment is performed by using a preshrinking machine at a preshrinking speed of 15 m/min to 25 m/min, a rubber blanket compression degree of 17% to 19%, a rubber blanket temperature of 120° C. to 140° C., and a blanket drying tube temperature of 120° C. to 140° C.

Through the singeing treatment on the elastic fabric, fiber fuzz on the surface of the elastic fabric may be removed, so that the surface of the elastic fabric becomes flat and smooth. Then, through the desizing treatment, the desizing enzyme acts on the elastic fabric to remove slurry on the surface of the warp yarn, so that the elastic fabric becomes relatively soft. Through the hot air flapping treatment working procedure, inner stress of the elastic fabric may be eliminated, and at the same time, the interweaving tightness of the warp yarn and the weft yarn on the elastic fabric may be reduced, so that the elastic fabric relatively becomes fluffy. At the same time, it is also favorable for the treatment of the later preshrinking working procedure, and the shrinkage rate reduction may be better realized. Through ozone treatment, the regenerated cellulose layer at the outer layer of the novel fiber may generate swelling or may be damaged, the moisture absorption capability of the novel fiber may be improved, the rigidity of the novel fiber may be reduced, and it is favorable for fast moisture adsorption and conduction of the fiber softening degrading agent into the inner layer during the softening treatment in the later working procedure. Through the softening treatment, the surface of the outer layer of the novel fiber is relatively smooth, and the holes are formed in the middle layer, so the softening effect of the wrapping yarn is good, the fiber between loops is inclined and is in a relative parallel state, the torsion degree of the fiber is smaller, the skin feels smooth when getting close to the connection positions, and the skin feeling of the elastic fabric is improved.

By using the elastic yarn of this application as the weft yarn and matching with the above after treatment processing process, the elastic fabric of this application has a good and stable elasticity (without elasticity loss of the fabric), a good skin feeling and a difficulty in causing scratch injury on the skin, and a stable shrinkage rate.

This application will be further illustrated through specific embodiments.

Embodiment 1

According to an elastic yarn of this application, a wrapping yarn was a blended yarn formed by 80% cotton fiber and 20% novel fiber and had a yarn count of 21 S, a corn yarn was 105 D spandex, and a draft multiple of the spandex was 1.5. An inner layer of the novel fiber was a polyester layer, a special-shaped cross section was in a cruciform shape, a middle layer was a polyurethane layer with a melting point of 100° C., an outer layer was a viscose layer, and a cross section area ratio of the outer layer to the middle layer to the inner layer was 3:1:6. By taking every 4 cm of the core yarn as a cycle, in the first 4 cm of the core yarn of each 4 cm of the core yarn, a number of windings of the wrapping yarn on the $1^{st}$ centimeter of the core yarn was 35, the number of windings on the $2^{nd}$ centimeter of the core yarn was 33, the number of windings on the $3^{rd}$ centimeter of the core yarn was 31, and the number of windings on the $4^{th}$ centimeter of the core yarn was 29; in the second 4 cm of the core yarn, the number of windings of the wrapping yarn on the $1^{st}$ centimeter of the core yarn was 35, the number of windings on the $2^{nd}$ centimeter of the core yarn was 33, the number of windings on the $3^{rd}$ centimeter of the core yarn was 31, and the number of windings on the $4^{th}$ centimeter of the core yarn was 29; and this cycle was repeated in such a manner.

A preparation process of the elastic yarn of this application was as follows: a blended yarn having a yarn count of 21 S and a twist degree of 18 twists/inch formed by 80% cotton fiber and 20% novel fiber was used as a wrapping yarn, 105 D spandex was used as a corn yarn, and the wrapping yarn spirally wrapped a surface of the corn yarn. In the wrapping process of the wrapping yarn, the twist degree of twisting of the wrapping yarn was 1250 twists/m. By taking every 4 cm of the core yarn as a cycle, in every 4 cm of the core yarn, if a number of windings of the wrapping yarn on per 1 cm of the core yarn was sequentially reduced by 2, a twist degree change of twisting of the wrapping yarn on per 1 cm of the core yarn was sequential reduction by 5%.

According to the elastic fabric of this application: a warp yarn used the 10 S pure cotton yarn, a weft yarn used the elastic yarn of this application, and the warp yarn and the weft yarn were interwoven to form a 3/1 twill structure.

According to a comparative elastic fabric, the warp yarn used a 10 S pure cotton yarn, a weft yarn used a pure cotton 21 S and 70 D spandex single-core-spun yarn, the draft multiple of the spandex was 3.5, and the warp yarn and the weft yarn were interwoven to form a 3/1 twill structure.

The elastic fabric of this application and the comparative elastic fabric were subjected to the follow after treatment processing:

(1) Singeing treatment: singeing treatment was respectively performed on a front side and a back side of the elastic fabric in a singeing machine at a singeing temperature of 300° C. and a singeing speed of 80 m/min.

(2) Desizing treatment: a desizing enzyme was added into a desizing machine to perform desizing treatment at a desizing enzyme concentration of 8 g/L, a desizing treatment temperature of 60° C. and a desizing speed of 75 m/min.

(3) Drying treatment: drying treatment was performed in a drying machine at a drying treatment temperature of 120° C. for a treatment time of 3 min.

(4) Hot air flapping treatment: hot air flapping treatment was performed on the elastic fabric. The hot air flapping treatment was divided into four stages, and a flapping frequency was constant and was set to be flapping once per 3 seconds: at a first stage, the hot air temperature was 120° C., and a flapping speed was 250 m/min; at a second stage, the hot air temperature was 110° C., and the flapping speed was 350 m/min; at a third stage, the hot air temperature was 100° C., and the flapping speed was 450 m/min; and at a fourth stage, the hot air temperature was 90° C., and the flapping speed was 550 m/min.

(5) Ozone treatment: the elastic fabric was soaked in a sodium hydroxide solution, ozone was introduced into the sodium hydroxide solution, a pH value of the sodium hydroxide solution was 8, an introduction amount of the ozone was set to be 0.5 L/min, and a treatment time was 10 min.

(6) Softening treatment: a fiber softening degrading agent was added into water at an addition amount of the fiber softening degrading agent accounting for 3% of a volume of water, and a treatment time was 15 min.

The fiber softening degrading agent was prepared from the following raw materials in percentage by weight:

25% of polyoxyethylene isooctyl ether phosphate, 50% of dodecyl dimethyl hydroxypropyl phosphate betaine, 3% of an auxiliary agent, and the balance water;

the auxiliary agent was hexadecyl trimethyl ammonium bromide; and a preparation process of the fiber softening degrading agent was as follows: the auxiliary agent was mixed with water to obtain a mixed liquid; and the polyoxyethylene isooctyl ether phosphate and the dodecyl dimethyl hydroxypropyl phosphate betaine were added into the mixed liquid, were uniformly mixed, and were stirred at 50° C. and at a speed of 280 r/min for 12 min to obtain the fiber softening degrading agent.

(7) Preshrinking treatment: preshrinking treatment was performed by using a preshrinking machine at a preshrinking speed of 25 m/min, a rubber blanket compression degree of 17%, a rubber blanket temperature of 120° C., and a blanket drying tube temperature of 130° C.

A performance test was performed on the elastic fabric of this application and the comparative fabric, and a result was as shown in Table 1.

An elasticity test was in accordance with the standard FZ/T 01034-2008: *Textiles—Test Method of the Tensile Elasticity for Woven Fabrics* to test the elasticity performance of the woven fabrics, such as elastic elongation, elastic resilience and elongation rates (i.e., plastic deformation).

A shrinkage rate test was in accordance with the standard AATCC 135-2015: Dimensional Changes of Fabrics after Home Laundering.

In a breadth test, a ruler was used for measuring a cloth width dimension.

TABLE 1

| | Gray fabric breadth (inch) | Breadth after singeing (inch) | Breadth after desizing (inch) | Breadth of finished product after preshrinking (inch) | Weft shrinkage rate (%) | Elastic elongation (%) | Elongation rate (%) | Elastic recovery rate (%) |
|---|---|---|---|---|---|---|---|---|
| Elastic fabric of this application | 66 | 63 | 58 | 55 | −3 | 76 | 2.8 | 95.6 |
| Comparative elastic fabric | 66 | 62 | 52.6 | 43.3 | −12.8 | 62 | 6.9 | 87.6 |

The finished product breadth of the elastic fabric of this application accounted for 83% of the gray fabric breadth, and the finished product breadth of the comparative elastic fabric accounted for 65.6% of the gray fabric breadth. Through comparison, it could be known that the elastic fabric of this application has low shrinkage rate, great finished product fabric breadth and good production benefits.

The elastic fabric became a finished product fabric through an after treatment processing, and the weft shrinkage rate, the elastic elongation and the elastic recovery rate were tested on the finished product fabric. Through the test, the shrinkage rate of the finished product fabric of the elastic fabric of this application was −3%, and the shrinkage rate of the finished product fabric of the comparative elastic fabric was −12.8%, so the dimension stability of the finished product fabric of the elastic fabric of this application was high. At the same time, the elastic elongation and the elastic recovery rate of the elastic fabric of this application were high, and the elongation rate was small, so after the long-time stretching, the recovery performance of the fabric was good, and the occurring probability of plastic deformation was small.

After the after treatment processing, comparing the elastic fabric of this application with the comparative elastic fabric, the elastic fabric of this application had a smoother surface, the elastic fabric of this application had a softer touch sense, and the elastic fabric of this application had a better comfortable feeling when being in contact with the skin.

Embodiment 2

According to an elastic yarn of this application, a wrapping yarn was a blended yarn formed by 75% cotton fiber and 25% novel fiber and had a yarn count of 21 S, a corn yarn was 70 D spandex, and a draft multiple of the spandex was 1.3. An inner layer of the novel fiber was a polyester layer, a special-shaped cross section was in a cruciform shape, a middle layer was a polyurethane layer with a melting point of 100° C., an outer layer was a viscose layer, and a cross section area ratio of the outer layer to the middle layer to the inner layer was 3:1:6. By taking every 4 cm of the core yarn as a cycle, in the first 4 cm of the core yarn of each 4 cm of the core yarn, a number of windings of the wrapping yarn on the $1^{st}$ centimeter of the core yarn was 34, the number of windings on the $2^{nd}$ centimeter of the core yarn was 32, the number of windings on the $3^{rd}$ centimeter of the core yarn was 30, and the number of windings on the $4^{th}$ centimeter of the core yarn was 28; in the second 4 cm of the core yarn, the number of windings of the wrapping yarn on the $1^{st}$ centimeter of the core yarn was 34, the number of windings on the $2^{nd}$ centimeter of the core yarn was 32, the number of windings on the $3^{rd}$ centimeter of the core yarn was 30, and the number of windings on the $4^{th}$ centimeter of the core yarn was 28; and this cycle was repeated in such a manner.

A preparation process of the elastic yarn of this application was as follows: a blended yarn having a yarn count of 21 S and a twist degree of 18 twists/inch formed by 75% cotton fiber and 25% novel fiber was used as a wrapping yarn, 70 D spandex was used as a corn yarn, and the wrapping yarn spirally wrapped a surface of the corn yarn. In the wrapping process of the wrapping yarn, the twist degree of twisting of the wrapping yarn was 1200 twists/m. By taking every 4 cm of the core yarn as a cycle, in every 4 cm of the core yarn, if the number of windings of the wrapping yarn on per 1 cm of the core yarn was sequentially reduced by 2, a twist degree change of twisting of the wrapping yarn on per 1 cm of the core yarn was sequential reduction by 5%.

According to the elastic fabric of this application, a warp yarn used a 10 S pure cotton yarn, a weft yarn used the elastic yarn of this application, and the warp yarn and the weft yarn were interwoven to form a 3/1 twill structure.

The elastic fabric of this embodiment was processed by an after treatment process the same as Embodiment 1.

A performance test was performed on the elastic fabric of this embodiment, and a result was as shown in Table 2.

TABLE 2

| Gray fabric breadth (inch) | Breadth after singeing (inch) | Breadth after desizing (inch) | Breadth of finished product after preshrinking (inch) | Weft shrinkage rate (%) | Elastic elongation (%) | Elongation rate (%) | Elastic recovery rate (%) |
|---|---|---|---|---|---|---|---|
| 68 | 65 | 61 | 57 | −3.2 | 76.3 | 2.9 | 95.1 |

From the result in Table 2, it could be known that the elastic fabric of this application had a low shrinkage rate, a great finished product fabric breadth and good production benefits. At the same time, the elastic elongation and the elastic recovery rate of the elastic fabric of this application were high, and the elongation rate was small, so after the long-time stretching, the recovery performance of the fabric was good, and the occurring probability of plastic deformation was small. After the after treatment processing, the elastic fabric of this application had a smooth surface, soft touch sense, and good comfortable feeling when being in contact with the skin.

It should be understood that the application of this application is not limited to the above examples, a person of an ordinary skill in the art may make improvements or modifications according to the above descriptions, and all of these improvements and modifications shall fall within the protection scope of this application.

What is claimed is:

1. An elastic yarn, comprising a core yarn and a wrapping yarn, wherein the core yarn is composed of at least one elastic filament;

the wrapping yarn is a yarn made of short fiber; and the wrapping yarn spirally wraps the core yarn;

wherein by taking every 4 cm of the core yarn as a cycle, a number of windings of the wrapping yarn on per 1 cm of the core yarn in every 4 cm of the core yarn is sequentially reduced by 2.

2. The elastic yarn according to claim 1, wherein a draft multiple of the core yarn is 1 to 3.

3. The elastic yarn according to claim 1, wherein a twist degree of the wrapping yarn before spirally wrapping the core yarn is 8 twists/inch to 30 twists/inch; and a number of windings of the wrapping yarn on per 1 cm of the core yarn is more than 15.

4. The elastic yarn according to claim 1, wherein the wrapping yarn is a blended yarn of cotton fiber and three-layer fiber, and according to a mass ratio of a blending proportion of the blended yarn, the cotton fiber accounts for 60% to 80%, and the three-layer fiber accounts for 20% to 40%;

the three-layer fiber sequentially comprises an inner layer, a middle layer and an outer layer from inside to outside, the inner layer is a chemical fiber layer with a cruciform or triangular cross section, and a cross section area ratio of the outer layer to the middle layer to the inner layer is (3-4):1:(5-7);

wherein the chemical fiber layer is made of polyester;

the middle layer is made of polyurethane with a low-melting-point not greater than 100° C.;

the outer layer is a regenerated cellulose layer of viscose.

5. An elastic fabric, interwoven by a warp yarn and a weft yarn, wherein the weft yarn uses the elastic yarn according to claim 4;

wherein the elastic fabric comprises holes in the middle layer;

wherein the elastic fabric is processed by an after treatment process, and the after treatment process comprises the following steps:

(1) performing singeing treatment on the elastic fabric: performing the singeing treatment a front side and a back side of the elastic fabric in a singeing machine at a singeing temperature of 300° C. to 500° C. and a singeing speed of 60 m/min to 80 m/min;

(2) performing desizing treatment on the elastic fabric: adding a desizing enzyme into a desizing machine to perform the desizing treatment at a desizing enzyme concentration of 6 g/L to 10 g/L, a desizing treatment temperature of 50° C. to 65° C. and a desizing speed of 60 m/min to 80 m/min;

(3) performing drying treatment on the elastic fabric at a drying treatment temperature of 110° C. to 130° C. for a treatment time of 3 min to 5 min;

(4) performing hot air flapping treatment on the elastic fabric at a hot air temperature of 90° C. to 120° C.;

(5) performing ozone treatment on the elastic fabric: introducing ozone in a sealed environment, soaking the elastic fabric in a liquid with a pH value being 8 to 8.5, and setting an ozone introduction amount to be 0.2 L/min to 1.5 L/min to perform the ozone treatment for a treatment time of 10 min to 20 min;

(6) performing softening treatment on the elastic fabric: adding a fiber softening degrading agent into water at an addition amount of the fiber softening degrading agent accounting for 3% to 5% of a volume of water to perform the softening treatment for a treatment time of 10 min to 20 min; and (7) performing preshrinking treatment on the elastic fabric: using a preshrinking machine at a preshrinking speed of 15 m/min to 25 m/min, a rubber blanket compression degree of 17% to 19%, a rubber blanket temperature of 120° C. to 140° C., and a blanket drying tube temperature of 120° C. to 140° C.

6. An elastic fabric, interwoven by a warp yarn and a weft yarn, wherein the weft yarn uses the elastic yarn according to claim 1.

7. The elastic fabric according to claim 6, wherein the warp yarn uses a pure cotton yarn or a cotton blended yarn, and a yarn count of the warp yarn ranges from 6 S to 50 S.

8. The elastic fabric according to claim 6, wherein the elastic fabric is processed by an after treatment process, and the after treatment process comprises the following steps:

(1) performing singeing treatment on the elastic fabric: performing the singeing treatment a front side and a back side of the elastic fabric in a singeing machine at a singeing temperature of 300° C. to 500° C. and a singeing speed of 60 m/min to 80 m/min;

(2) performing desizing treatment on the elastic fabric: adding a desizing enzyme into a desizing machine to perform the desizing treatment at a desizing enzyme concentration of 6 g/L to 10 g/L, a desizing treatment temperature of 50° C. to 65° C. and a desizing speed of 60 m/min to 80 m/min;

(3) performing drying treatment on the elastic fabric at a drying treatment temperature of 110° C. to 130° C. for a treatment time of 3 min to 5 min;

(4) performing hot air flapping treatment on the elastic fabric at a hot air temperature of 90° C. to 120° C.;

(5) performing ozone treatment on the elastic fabric: introducing ozone in a sealed environment, soaking the elastic fabric in a liquid with a pH value being 8 to 8.5, and setting an ozone introduction amount to be 0.2 L/min to 1.5 L/min to perform the ozone treatment for a treatment time of 10 min to 20 min;

(6) performing softening treatment on the elastic fabric: adding a fiber softening degrading agent into water at an addition amount of the fiber softening degrading agent accounting for 3% to 5% of a volume of water to perform the softening treatment for a treatment time of 10 min to 20 min; and (7) performing preshrinking treatment on the elastic fabric: using a preshrinking machine at a preshrinking speed of 15 m/min to 25 m/min, a rubber blanket compression degree of 17% to 19%, a rubber blanket temperature of 120° C. to 140° C., and a blanket drying tube temperature of 120° C. to 140° C.

9. The elastic fabric according to claim 8, wherein in Step (4), the hot air flapping treatment is divided into four stages, and a flapping frequency is set to be flapping once per 1 second to 5 seconds: at a first stage, the hot air temperature is 120° C., and a flapping speed is 250 m/min; at a second stage, the hot air temperature is 110° C., and the flapping speed is 350 m/min; at a third stage, the hot air temperature is 100° C., and the flapping speed is 450 m/min; and at a fourth stage, the hot air temperature is 90° C., and the flapping speed is 550 m/min;

in step (5), the liquid is a sodium hydroxide solution; and in step (6), the fiber softening degrading agent is prepared from the following raw materials in percentage by weight:

15% to 25% of polyoxyethylene isooctyl ether phosphate, 25% to 55% of dodecyl dimethyl hydroxypropyl phosphate betaine, 1% to 5% of an auxiliary agent, and water making up the balance to 100% by weight;

the auxiliary agent is hexadecyl trimethyl ammonium bromide; and a preparation process of the fiber softening degrading agent comprises: mixing the auxiliary agent with water to obtain a mixed liquid: adding the polyoxyethylene isooctyl ether phosphate and the dodecyl dimethyl hydroxypropyl phosphate betaine into the mixed liquid, performing uniform mixing, and performing stirring at 45° C. to 55° C. and at a speed of 120 r/min to 320 r/min for 8 min to 15 min to obtain the fiber softening degrading agent.

10. The elastic fabric according to claim 6, wherein the elastic fabric is a jean fabric with a fabric structure of 3/1 right twill.

* * * * *